US007524035B2

(12) United States Patent
Bruinsma et al.

(10) Patent No.: US 7,524,035 B2
(45) Date of Patent: Apr. 28, 2009

(54) FLUID EJECTION DEVICE

(75) Inventors: Paul J. Bruinsma, San Diego, CA (US); Matthew D. Giere, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 519 days.

(21) Appl. No.: 10/977,065

(22) Filed: Oct. 29, 2004

(65) Prior Publication Data

US 2006/0033783 A1 Feb. 16, 2006

Related U.S. Application Data

(60) Provisional application No. 60/600,553, filed on Aug. 10, 2004.

(51) Int. Cl.
*B41J 2/15* (2006.01)

(52) U.S. Cl. ..... 347/65

(58) Field of Classification Search ..... 347/54, 347/56, 65

See application file for complete search history.

(56) References Cited

U.S. PATENT DOCUMENTS 5,831,648 A * 11/1998 Mitani et al. ..... 347/62
6,820,963 B2 * 11/2004 Stauffer et al. ..... 347/43
6,938,986 B2 * 9/2005 Macler et al. ..... 347/45

* cited by examiner

*Primary Examiner*—An H Do

(57) ABSTRACT

A fluid ejection device includes an orifice structure with an orifice. A fluid reservoir is on the exterior surface of the orifice structure. A barrier portion is between the fluid reservoir and the orifice.

61 Claims, 8 Drawing Sheets

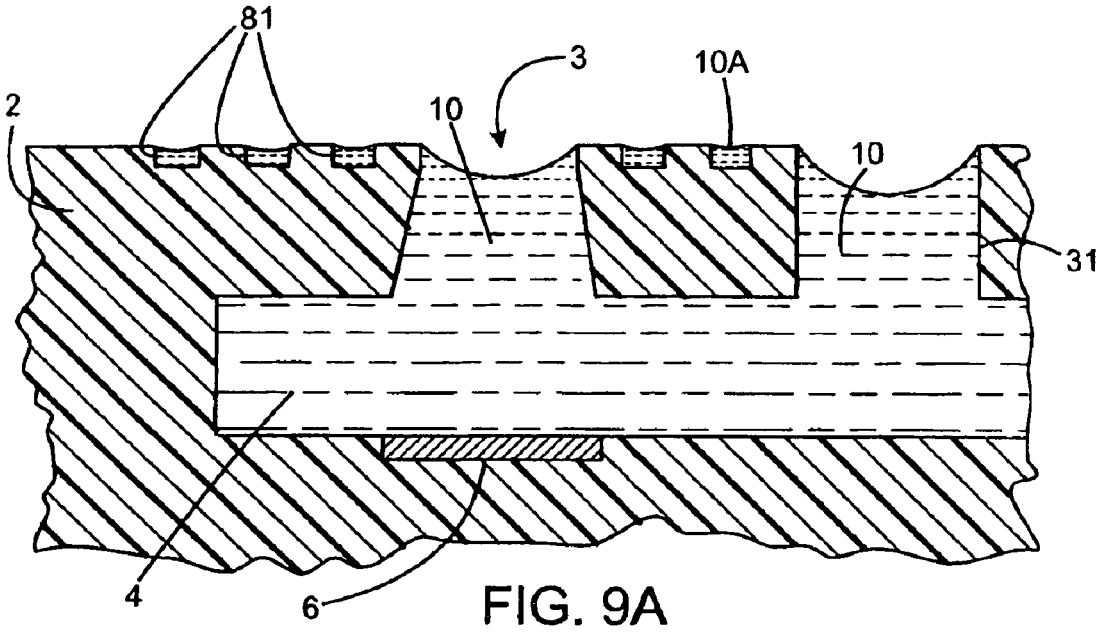
FIG. 9A
FIG. 9B
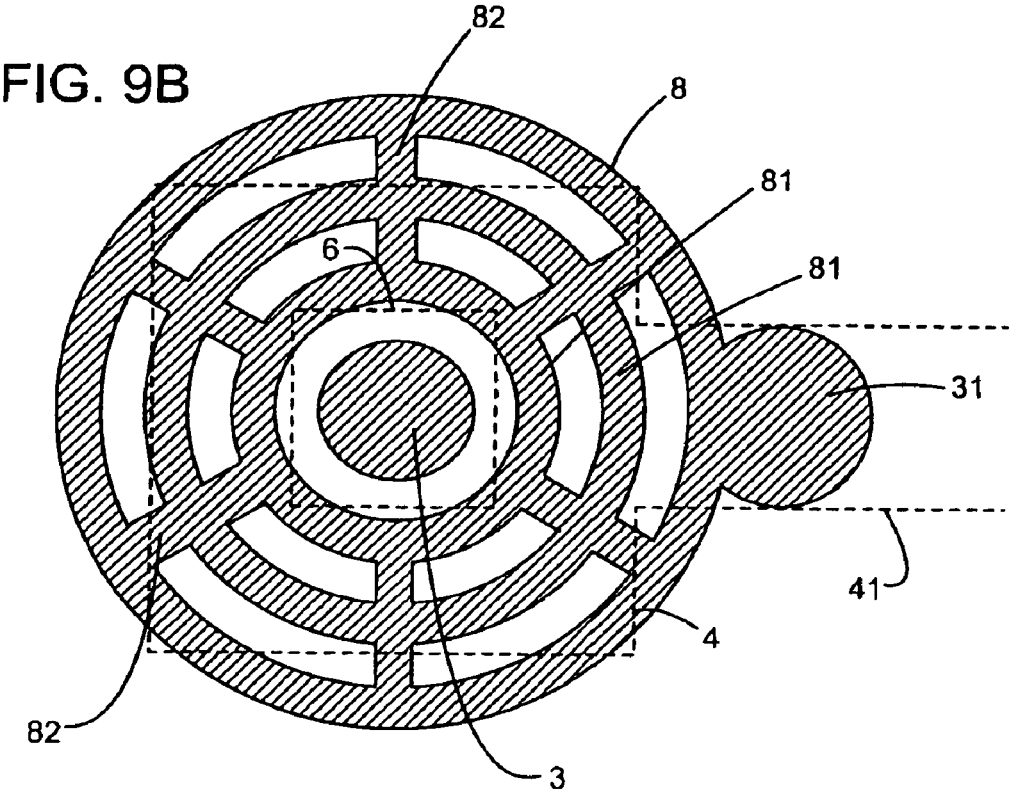

FLUID EJECTION DEVICE

CROSS-REFERENCE TO RELATED APPLICATIONS

This application claims the benefit of U.S. Provisional Application No. 60/600,553, filed on Aug. 10, 2004.

BACKGROUND OF THE DISCLOSURE

Some fluid ejection devices, including, for example, inkjet printheads, have an orifice plate or orifice layer with nozzles or orifices through which fluid is ejected. Firing resistors in a firing chamber located below the orifice plate are selectively energized, thereby heating fluid in the chamber, causing some of the fluid in the chamber to boil and form a vapor bubble. The expanding vapor bubble pushes on the fluid, causing a drop of the fluid to be ejected from the nozzle.

Fluids to be ejected through the nozzles may include non-volatile components and volatile components. For example, in the case of an inkjet printhead an ink may be comprised of non-volatile dye or pigment components, non-volatile organic co-solvents, surfactants or buffers and a volatile component such as water. After a drop of fluid has been ejected, fluid entering the chamber refills the nozzle by capillary action. Between drop ejections, fluid remains in the nozzle and is subject to evaporation or diffusion of volatile components of the fluid out through the nozzle. As the volatile components of the remaining fluid evaporate from the open nozzle surface, non-volatile components are left behind. Such non-volatile components accumulate in the remaining volatile components over a period of several seconds and can increase the viscosity of fluid at the nozzle or form solid precipitates.

The increased viscosity fluid and/or the solid precipitates can reduce the performance of the fluid ejection device. For example, higher viscosity fluid or particulates in the nozzle can clog the nozzle, reduce the amount of fluid ejected through the nozzle, change the directional characteristics of drops ejected from the nozzle or otherwise alter the dynamics of drop ejection from the nozzle and degrading the performance of the fluid emitter. To maintain nozzle performance the ink can be periodically ejected or "spit" into a service station spittoon, to clear out evaporated ink from the nozzle. The use of a service station in this manner can reduce printer throughput speed and waste ink.

BRIEF DESCRIPTION OF THE DRAWINGS

Features and advantages of the disclosure will be readily appreciated by persons skilled in the art from the following detailed description of exemplary embodiments thereof, as illustrated in the accompanying drawings, in which:

FIG. 9A illustrates a cross-sectional view of an exemplary embodiment of a fluid ejection device.

FIG. 9B illustrates a cross-sectional view of an exemplary embodiment of a fluid ejection device.

DETAILED DESCRIPTION OF THE DISCLOSURE

Figure 1A:
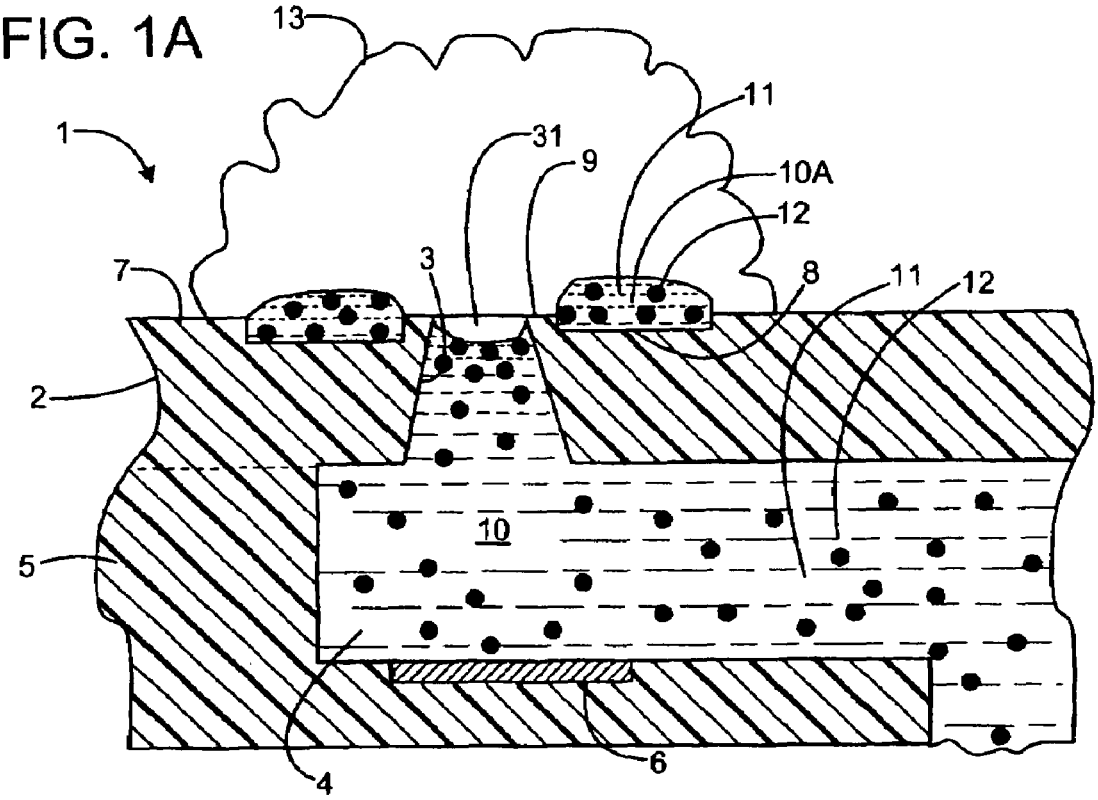
FIG. 1A illustrates a cross-sectional view of an exemplary embodiment of a fluid ejection device.

In the following detailed description and in the several figures of the drawing, like elements are identified with like reference numerals.

Figure 1B:
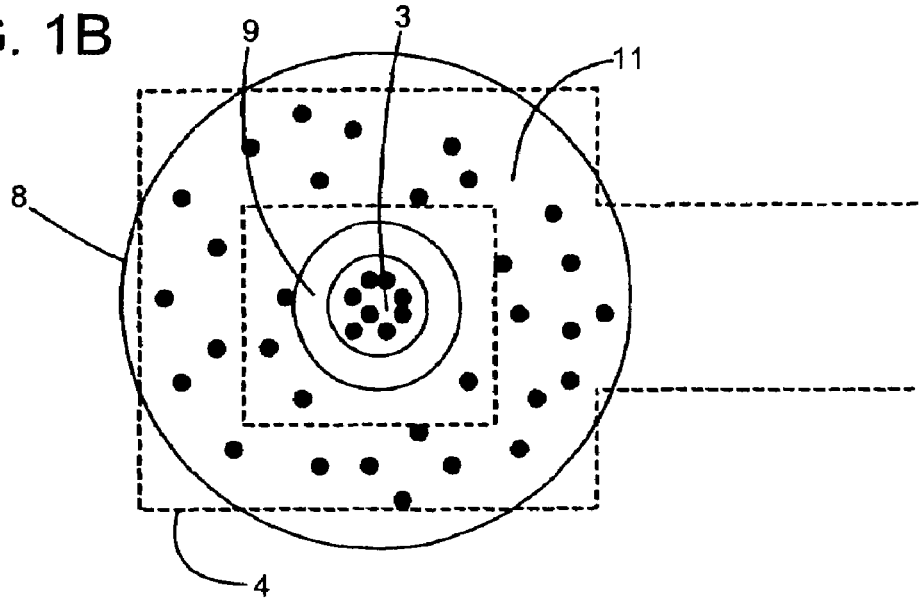
FIG. 1B illustrates a top view of the exemplary embodiment of FIG. 1A.

FIGS. 1A and 1B illustrate a cross-sectional view and a top view respectively of an exemplary embodiment of a fluid ejection device 1. The fluid ejection device 1 includes an orifice layer 2. The orifice layer 2 includes an orifice 3 extending from a chamber 4 formed in a barrier layer 5. A resistor 6 can be selectively energized to cause some of the fluid 10 in chamber 4 to boil and expand, thereby creating a vapor bubble and causing a droplet of fluid 10 to be ejected from the orifice 3. After firing the resistor 6 and ejection of fluid 10, the resistor 6 and fluid 10 within the ejection chamber 4 and orifice 3 cool and the vapor bubble collapses. Fluid 10 may refill the chamber 4 and/or the orifice 3, replacing the ejected fluid, by capillary wetting. In an exemplary embodiment (not shown), a fluid ejection device 1, for example an ink jet printhead, may have a plurality of orifices with corresponding chambers and resistors wherein each firing resistor can be selectively energized to eject droplets from selected orifices. In an exemplary embodiment, the orifice may have a diameter from about 6 μm to about 30 μm.

In an exemplary embodiment, the external surface 7 of the orifice layer 2 may have a fluid reservoir 8. In an exemplary embodiment, the fluid reservoir 8 may be located near the orifice 3. In an exemplary embodiment, the fluid reservoir may be located within 2 μm of the orifice. In an exemplary embodiment, the fluid reservoir 8 comprises a trench extending around the orifice 3. In an exemplary embodiment, the trench is a circular trench about 2 μm deep and which may be about 30 μm wide. In an exemplary embodiment, a barrier portion 9 (or weir) separates the reservoir 8 from the exit 31 of the orifice 3. In an exemplary embodiment, the barrier portion 9 is within a range of about 2 to 10 μm wide. In an exemplary embodiment, the barrier portion 9 detaches puddles of fluid 10A in the reservoir 8 from the orifice and may prevent fluid 10A from being pulled back into the bulk of fluid within the orifice 3 and chamber 4. Such puddles may be formed when a portion or portions of ejected fluid 10 overflows slightly onto the external surface 7 of the orifice layer 2 as fluid is ejected from the orifice 3.

In an exemplary embodiment, fluid 10 in the orifice 3 and chamber 4 is held at about ten centimeters of water backpressure to prevent fluid 10 from drooling out from the exit 31 of the orifice 3 with the hydrostatic head of the fluid 10. Fluid 10A, for example ink, on the external surface 7 of the orifice layer 2 and in fluidic connection with the fluid 10 within the orifice 3 is drawn back into the orifice 3 by the backpressure. Capillary wetting action prevents the ink from being drawn out of the orifice 3.

In an exemplary embodiment, the fluid reservoir 8 is within close proximity of the orifice 3, for example within 2 to 10 μm of the orifice 3 or nozzle, which may allow refreshing of the fluid reservoir 8 with new fluid 10A on each ejection. In an exemplary embodiment, the barrier portion 9 provides a finite fluidic separation between the exit 31 of the orifice 3 and the reservoir 8. In an exemplary embodiment, the barrier portion 9 may prevent complete drainage of fluid from the reservoir 8 back down into the orifice 3. In a design without a reservoir 8, fluid 10A on the external surface 7 of the orifice layer 2 may drain completely back into the orifice after completion of the drop ejection.

In an exemplary embodiment, the orifice layer 2 comprises a polyimide film such as Kapton (™), which is commercially available from DuPont. The orifice layer may also comprise a photo-resistive polymer or epoxy, such as SU-8 which is commercially available from Microchem, Inc., or a metal plate. In an exemplary embodiment, the reservoir 8 is formed using laser ablation. In further exemplary embodiments, the reservoir is formed using photo-etching of a layer of polymer forming resin with a photo-initiated catalyst at the top of an orifice layer or electrochemically etching of a metal plate.

In an exemplary embodiment, the reservoir 8 may hold a volume of fluid 10A. In an exemplary embodiment, the reservoir 8 can hold a volume of fluid 10A equal to about three times the volume of individual droplets ejected from the fluid ejection device. In an exemplary embodiment, the reservoir 8 may hold on the order of about 6 to 60 pl (picoliter). In an exemplary embodiment, fluid 10 is held within the chamber 4 and wets up into the orifice 3. In an exemplary embodiment, the fluid 10A in the reservoir 8 collects on the external surface 7 of the orifice layer 2 after the resistors are fired and droplets ejected from the orifice exit 31. In an exemplary embodiment, some of the fluid ejected through the orifice exit is detached from the ejected droplet and is drawn back by wetting onto the external surface 7 of the orifice layer 2.

In an exemplary embodiment, some of the fluid 10A that overflows onto the surface 7 of the orifice layer 2 during or after drop ejection collects in the reservoir 8. In an exemplary embodiment, some of the fluid 10A that collected on the surface 7 is drawn back into the orifice by back pressure. In an exemplary embodiment, the backpressure is approximately 10 centimeters of water.

In an exemplary embodiment, the fluid reservoir 8 has a wetting characteristic sufficient to hold fluid in the reservoir 8 against the back pressure from the orifice 3. In an exemplary embodiment, the barrier portion 9 is less wettable than the reservoir 8. In an exemplary embodiment, the barrier portion 9 may be non-wettable and the reservoir 7 may be wettable. The wettability characteristic of the barrier portion 9 and reservoir 8 may be selected based on a characteristic of the fluid 10. For example, the surface of the reservoir 8 may be textured (or roughened) and/or chemically modified such as by oxygen plasma treatment to increase the surface energy and enhance wetting of the fluid.

In an exemplary embodiment, the fluid 10 has volatile 11 and non-volatile portions 12. In the case of ink, for example, the volatile portion 11 may comprise water and the non-volatile portion 12 may comprise dyes, pigments and/or a buffer agent for controlling pH of the fluid. The volatile portion 11 may comprise volatile matter other than water. Volatile portions 11 of fluid 10 within the chamber 4 evaporate out through the orifice 3 and the nozzle exit 31. Volatile components in the fluid 10A in the reservoirs 8 also evaporate. Evaporated volatile components 11 from the fluid reservoirs 8 and from the orifices 3 combine to form a localized region 13 of increased concentration of volatile portions 11 in the air around and in the vicinity of the orifices 3. In the case of fluids 10 that comprise water, for example, water molecules 11 evaporate from the fluid 10 in the reservoirs 8 and from within the orifice 3 and/or chamber 4 creating a localized region of increased humidity 13.

The reservoir 8 and fluid 10A in the reservoir 8 increase the surface area of fluid 10, 10A subject to evaporation. In an exemplary embodiment, the total rate of evaporation and the concomitant rate of loss of volatile components 12, for example water, is increased. However, the resultant localized region of increased humidity 13 may decrease the rate of evaporation of volatile portions 11 from fluid 10, 10A in that localized region 13 and in turn, decrease the rate at which the concentration of the non-volatile components 12 in the orifice 3 increases. As a result, the time it takes for fluid 10 in an orifice 3 within the localized region of increased volatile component concentration 13 to evaporate increases, thereby increasing the time before fluid 10 in an orifice 3 becomes excessively viscous and/or forms plugs of non-volatile precipitates. As a result, it is believed that the performance of the fluid ejection improves.

One indication of the degree to which an orifice is plugged is the number of "spits" required to achieve good fluid ejection device performance. Fluid ejection devices may be programmed to "spit" periodically to clear plugged orifices of increased viscosity fluid or plugs. The number of spits required to clear an orifice after a given amount of elapsed time from the last firing of the orifice may be decreased for orifices with fluid reservoirs near the orifice exits. In exemplary embodiments of fluid ejection devices, for example inkjet printers, a printhead, or series of printheads, with a plurality of orifices or nozzles are arranged in columns perpendicular to the scan axis of printhead carriage. One or two of each of the columns of nozzles may be used to eject each of various types of fluid, for example different colored inks, for example black, cyan, magenta and/or yellow. The columns are swept back-and-forth by the printhead carriage. This motion may exacerbate the clogging of the idle nozzles by speeding drying. The tendency for the nozzles for an ink and printhead combination to clog can be tested by simulating the drying due to the printhead carriage motion. A printhead may be swept back-and-forth several seconds without ejecting ink drops from the nozzles. After the sweeping interval, a series of lines one millimeter apart are produced by spitting a drop of ink from each of the nozzles in a column onto a sheet of paper. If the nozzle is clogged, the first line or several lines may be absent or have a jagged appearance. After several successive firings, the nozzles tend to become unclogged and eject drops of ink normally. For a given carriage sweeping time, the number of lines that are absent or have a jagged appearance before sharp, vertical lines are printed can be used as a measure of the clogging tendency: the more quickly sharp, vertical lines are printed, the lower the tendency of the nozzles to clog. In an exemplary embodiment, providing a reservoir 8 on an external surface 7 of an orifice layer 2 of a fluid ejection device may increase the time for an orifice to plug and/or reduce the number of firings required to clear a clogged orifice.

In an exemplary embodiment, the barrier portion 9 may be textured so that the surface of the barrier portion 9 will be sufficiently wettable to hold fluid against the back pressure from the nozzle. For example, the barrier portion may be textured with a network of small grooves which feed fluid to the reservoir portion, similar to the network of small grooves 83 as shown in the exemplary embodiments of FIGS. 2A and 2B.

Figure 2A:
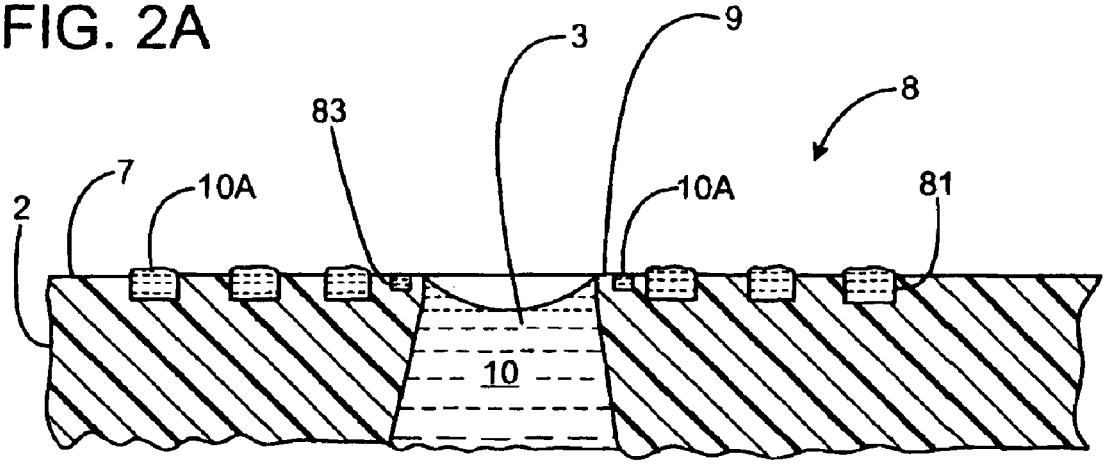
FIG. 2A illustrates a cross-sectional view of an exemplary embodiment of a fluid ejection device.
Figure 2B:
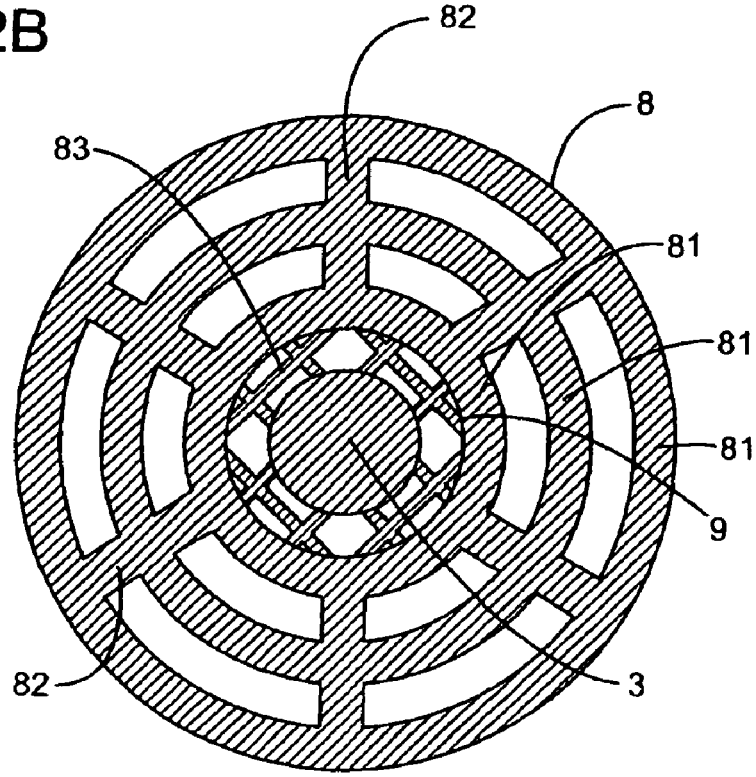
FIG. 2B illustrates a top view of the exemplary embodiment of FIG. 2A.

FIGS. 2A and 2B illustrate across-sectional view and top view, respectively, of an exemplary embodiment of an orifice layer of a fluid ejection device. The orifice layer 2 has an orifice or nozzle 3. The orifice 3 extends from a firing chamber 4 within a barrier layer 5 to an orifice exit 31 at an external surface 7 of the orifice layer 2 (similar to those shown in FIG. 1A). In an exemplary embodiment, the orifice may have a diameter from about 6 μm to about 30 μm. Fluid 10 within the chamber and orifice 3 is ejected out from the orifice and some fluid 10A collects in a reservoir 8 formed at in the external surface 7 of the orifice layer 2. In an exemplary embodiment, the reservoir 8 comprises a network of channels 81, 82. In another exemplary embodiment, the reservoir 8 comprises a plurality of substantially concentric, annular channels 81 completely encircling the orifice exit. In an additional exemplary embodiment, the reservoir 8 comprises at least one radial channel 82. In a further exemplary embodiment, the reservoir 8 comprises a plurality of concentric channels 81 joined by radial channels 82. In an exemplary embodiment, a barrier portion 9 separates the orifice exit 31 of the orifice 3 from the reservoir 8.

In an exemplary embodiment, the channels 81 are about 5 μm deep and 10 μm wide. In an exemplary embodiment, an innermost channel 81 may have a radius which is greater than the nozzle radius by about 5 μm, the width of an exemplary barrier portion 9. In an exemplary embodiment, a series of circular channels 81 extend on the external surface 7 of the orifice layer 2 in the region 15 μm to 30 μm from the center of the nozzle exit. In an exemplary embodiment, the radial channels are about 10 μm deep, 20 μm wide and the series of channels extend up to about 40 μm from the center of the nozzles. In an exemplary embodiment, the radial channels 82 terminate at one end at the barrier portion 9.

In an exemplary embodiment, the barrier portion 9 is textured. In an exemplary embodiment, the barrier portion 9 is textured with a network of grooves 83 which have lesser radii of curvature than those of the channels 81, 82. In an exemplary embodiment, the texturing is formed using laser ablation. In an exemplary embodiment, the network of grooves 83 comprises crisscross grooves about 1 μm wide and about 1 μm deep.

In an exemplary embodiment, the barrier portion 9 is textured such that the barrier portion 9 is sufficiently wettable to hold fluid against back pressure from the capillary action of fluid within the orifice 3. The network of grooves 83 feeds ink from the nozzle into the network of larger-radius channels 82, 83 which hold more ink volume further away from the perimeter of the nozzle exit. It is believed that having grooves 83 in contact with the nozzle exit may provide better drop ejection. If large grooves or channels were in direct contact with the nozzle exit, a major fraction of the fluid, for example ink, forced out of the nozzle could be diverted into the channels rather than in the ejected fluid droplets. Large channels in direct contact with the nozzle exit could make drop ejection, for example onto the paper surface, less efficient. In an alternate embodiment (not shown), the barrier portion 9 is not textured, similar to the barrier portion 9 shown in FIGS. 1A and 1B.

Figure 3A:
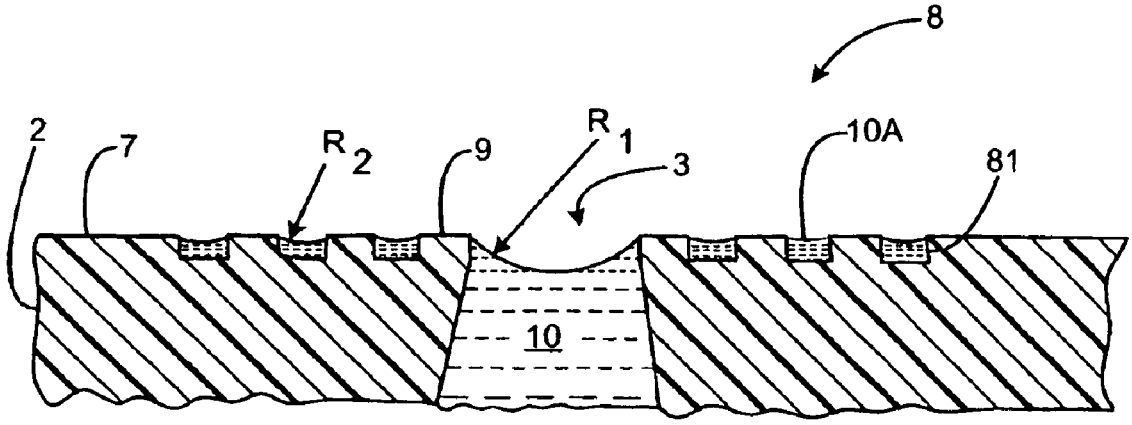
FIG. 3A illustrates a cross-sectional view of an exemplary embodiment of a fluid ejection device.
Figure 3B:
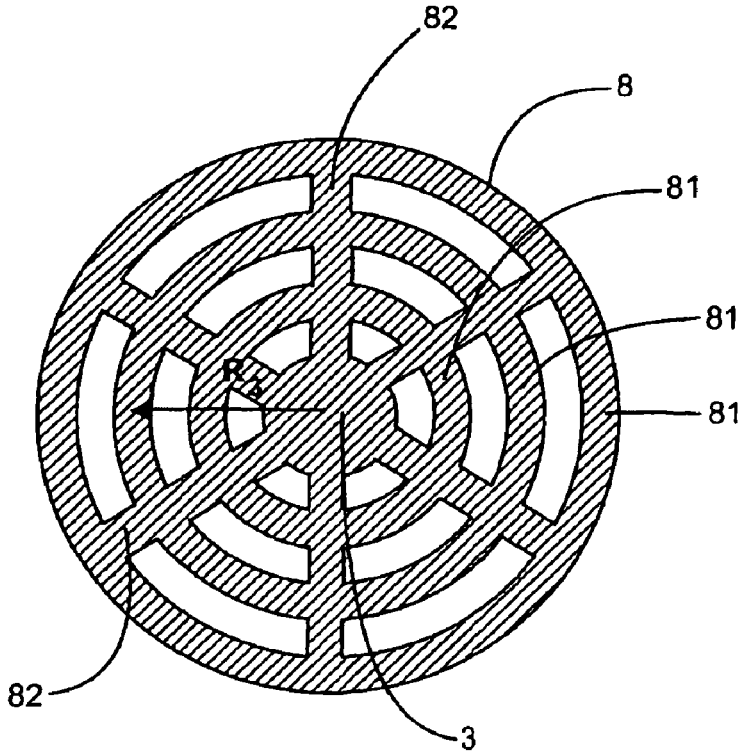
FIG. 3B illustrates a top view of the exemplary embodiment of FIG. 3A.

FIGS. 3A and 3B illustrate a cross-sectional view and top view, respectively, of an exemplary embodiment of an orifice layer 2 of a fluid ejection device. The orifice layer 2 comprises an orifice 3, a reservoir 8 and a barrier portion 9. Fluid 10 within the chamber and orifice 3 is ejected out from the orifice and some fluid 10A collects in the reservoir 8. In an exemplary embodiment, the orifice may have a diameter from about 6 μm to about 30 μm. The reservoir comprises radial channels 82 and circular channels 83. The radial channels 82 are smaller than the circular channels 83 and feed fluid from the orifice, through the barrier portion 9 to the larger channels 81. In an exemplary embodiment, the radial channels 82 are smaller in at least one of cross-sectional area, width or depth. Having the smaller channels in contact with the orifice is believed to disrupt fluid ejection from the orifice less than larger channels would. In an exemplary embodiment, the channels 82 are about 3 um wide and 3 um deep and the larger channels 81 are about 5 μm wide and 5 μm deep. The combination of curvature of reservoir 8, including the channels 81, 82, along with the contact angle of the fluid with the material making up the external surface 7 of the orifice layer 2 are such that the reservoir 8 maintains wetting of fluid within the reservoir 8 against the withdrawing force of backpressure into the orifice 3. The channels are cut such that fluid 10A is held in the channels by capillary wetting. Because the fluidic connection is be maintained between the ink in the reservoir and in the nozzle, the hydrostatic head of the fluid in the nozzle and in the reservoir are equal.

The balance between the capillary wetting force and the hydrostatic head is given by $2\gamma/R=gh\rho$ where $\gamma$ is the surface tension, R is the radius of curvature of the fluid-air interface, g is the acceleration of gravity and $\rho$ is the fluid density. The hydrostatic head is a mechanically applied backpressure in the thermal inkjet printhead that prevents draining of fluid out of the nozzles. Because the hydrostatic head has a negative value, the radius of curvature of the fluid-air interface also has a negative value, e.g. concaved. In the exemplary embodiment of FIGS. 3A and 3B, the radius of curvature of the fluid/air interface in the orifice is $-1/(1/R_1+1/R_1)$. The radius of curvature of the fluid/air interface in the reservoir is $-1/(1/R_2+1/R_3)$. Because the radii of curvature are related to the backpressure and the backpressure in the nozzle and in the reservoir are the same, $1/(1/R_1+1/R_1)=1/(1/R_2+1/R_2)$ The minimum radius of curvature the fluid can assume is influenced by the geometry of the wetted surface and the contact angle between the fluid and the solid surface. In general, the radius of curvature of the fluid-air interface will be larger than the radius of curvature of the capillary or channel that holds the fluid by wetting. For fluid surface tension of 30 mN/m; and contact angle of 15 degrees with the solid material making up the walls of the orifice and the channels; and a fluid density near water, the hydrostatic head of 10 centimeters can be balanced by wetting in a 59 μm radius capillary. In the exemplary embodiment illustrated in FIGS. 3A and 3B, the channels 81, 82 have an average radius of curvature less than or up to the radius of the orifice, which in an exemplary embodiment may be from 5 to 20 μm.

Figure 4:
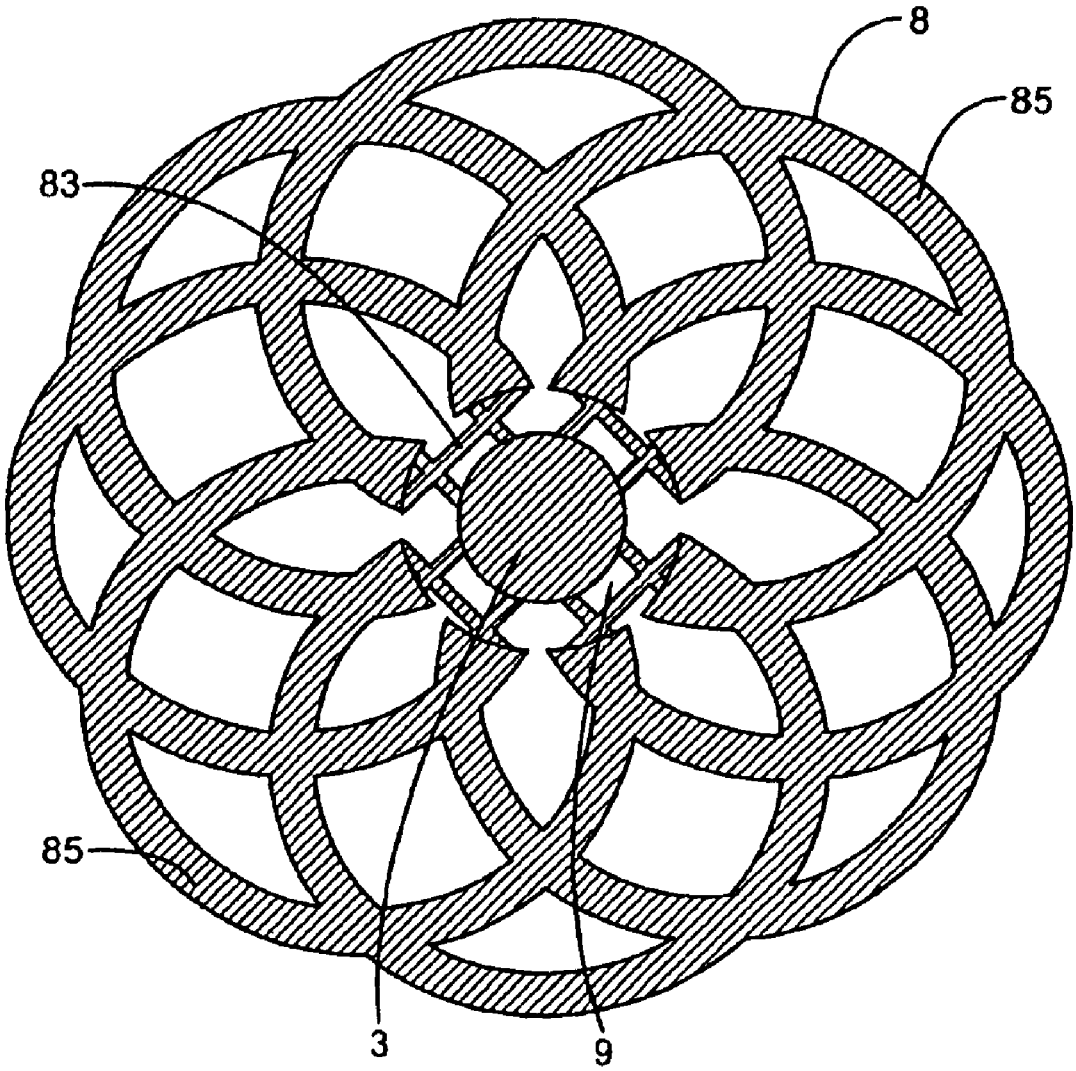
FIG. 4 illustrates a top view of an exemplary embodiment of an orifice layer.

FIG. 4 illustrates a top view of an exemplary embodiment of an orifice layer 2 of a fluid ejection device 1. The orifice layer 2 has a fluid reservoir 8 and a barrier portion 9 between the fluid reservoir 8 and the orifice exit 31. In an exemplary embodiment, the barrier portion 8 is textured. In an exemplary embodiment, the texture of the barrier portion comprises a network of grooves 83. In an exemplary embodiment (not shown) the barrier portion is not textured.

In an exemplary embodiment, the reservoir comprises a network of channels 85. In an exemplary embodiment, the channels 85 are 5 μm deep and about 5 μm wide. In an exemplary embodiment, the channels 85 comprise a network of intersecting arcs 85 which terminate at either end at the barrier portion 9.

Figure 5:
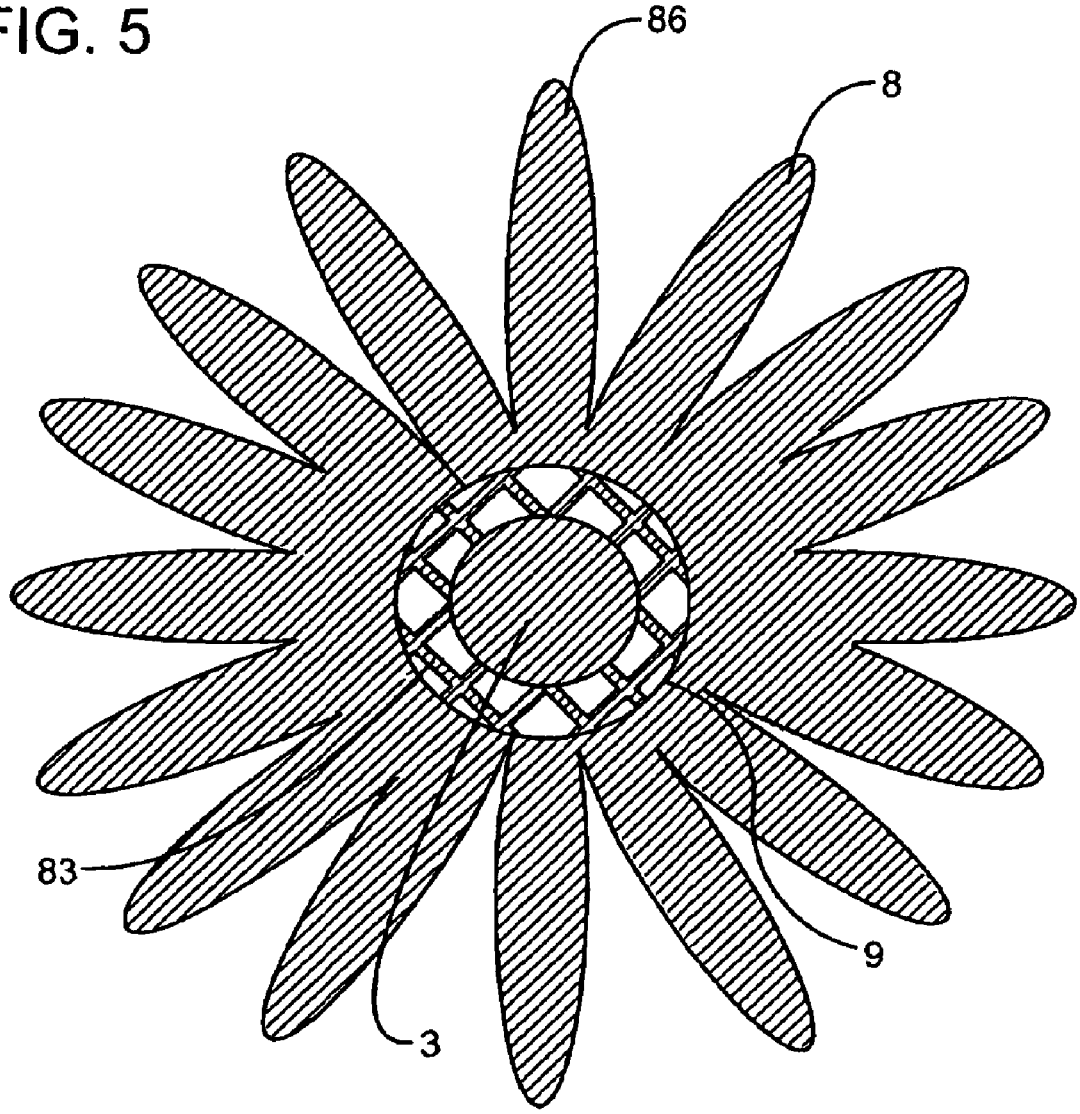
FIG. 5 illustrates a top view of an exemplary embodiment of an orifice layer.

FIG. 5 illustrates an exemplary embodiment of an orifice layer 2 of a fluid ejection device 1. The orifice layer 2 has a fluid reservoir 8 and a barrier portion 9 between the reservoir 8 and the orifice exit 31. In an exemplary embodiment, the barrier portion 9 is textured. In an exemplary embodiment, the texture of the barrier portion 9 comprises a network of grooves 83. In an exemplary embodiment (not shown) the barrier portion is not textured.

In an exemplary embodiment of FIG. 5, the reservoir 8 comprises a plurality of channels 86. In an exemplary embodiment, the reservoir 8 comprises a plurality of channels 86 extending radially away from the barrier portion and terminating at one end at the barrier portion 9. In an exemplary embodiment, the reservoir 8 comprises a plurality of lobe-shaped or elongated channel 86. In an exemplary embodiment, the reservoir comprises a plurality of channels 86 with a length of about 20 μm and a width of about 4 μm and a depth of about 4 μm.

Figure 6:
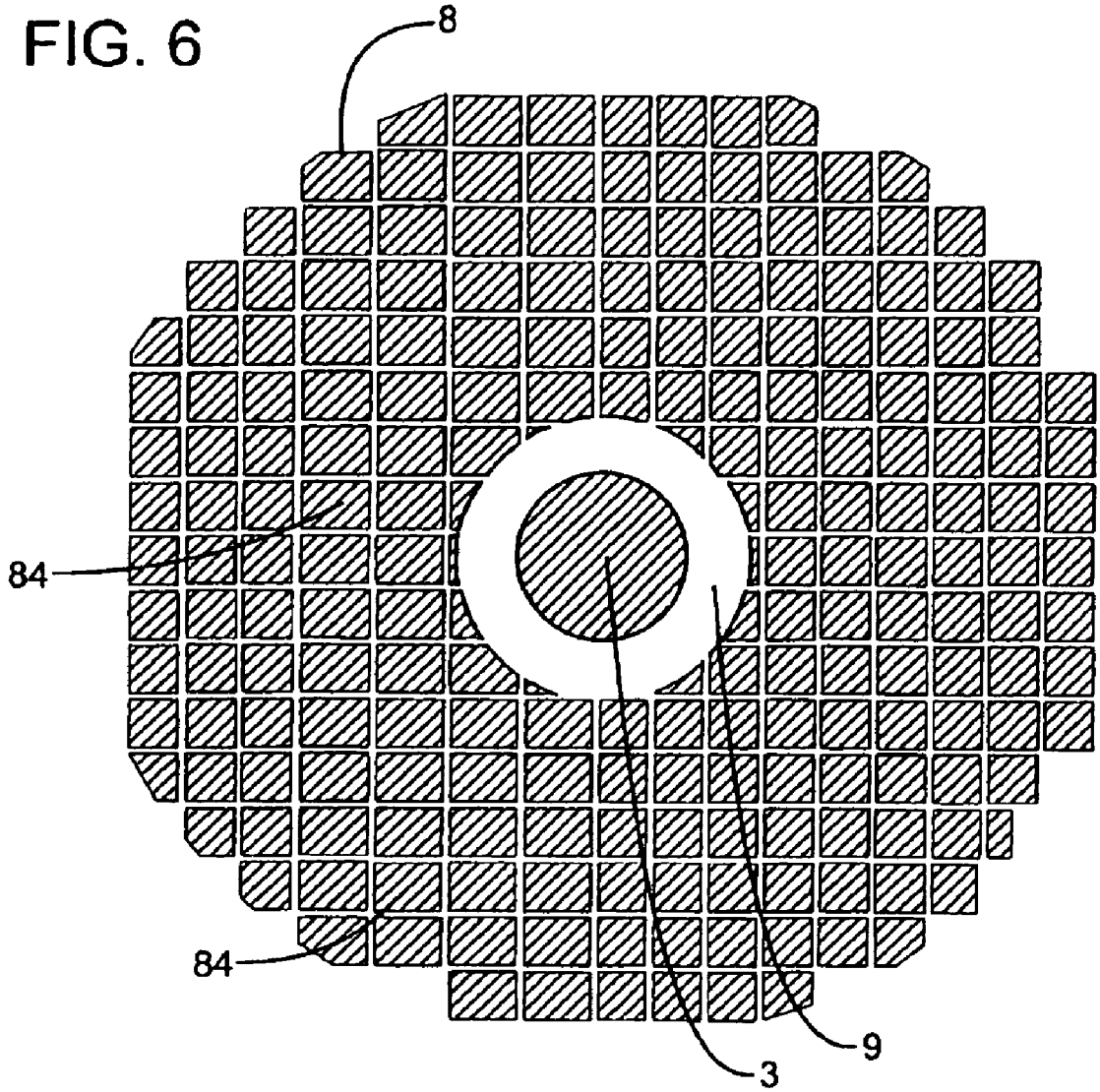
FIG. 6 illustrates a top view of an exemplary embodiment of an orifice layer.

FIG. 6 illustrates a top view of an exemplary embodiment of an orifice layer 2 with a reservoir 8. In an exemplary embodiment, the reservoir 8 comprises a plurality of indentations 84 in the surface 7 of the orifice layer 2. In an exemplary embodiment, the reservoir 8 comprises an array of indentations 84 arranged in a checkerboard pattern. In an exemplary embodiment, the indentations are about 2 μm wide, 2 μm deep and spaced about 4 μm apart. In an exemplary embodiment, a barrier portion 9 separates the reservoir from the reservoir. In an exemplary embodiment, the array of indentations 84 provides a texture to the surface 7 of the orifice layer 2. In an exemplary embodiment, the radius of curvature at the air/fluid interface of the fluid that wets in the indentations 84 is sufficient to hold fluid in the reservoir against back pressure from fluid within the orifice 3.

Figure 7:
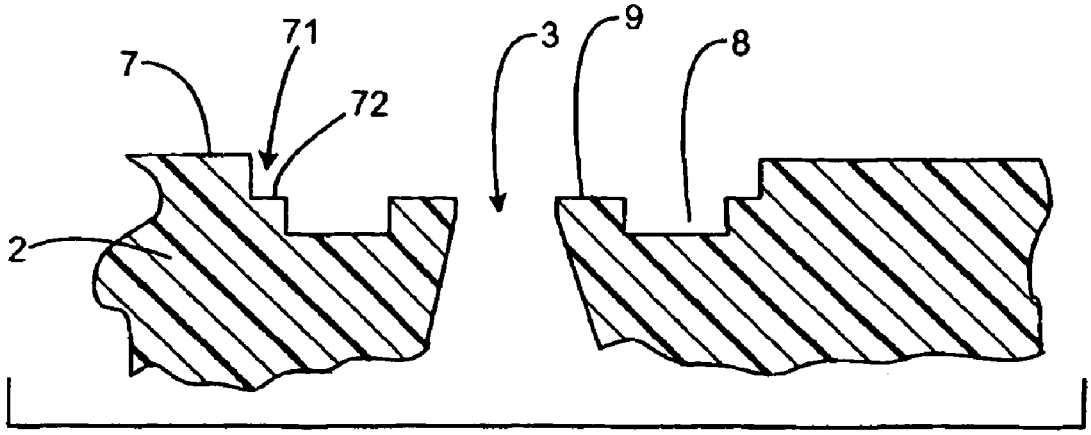
FIG. 7 illustrates a cross-sectional view of an exemplary embodiment of a fluid ejection device.

FIG. 7 illustrates a cross-sectional view of an exemplary embodiment of an orifice layer 2 with a reservoir 8. In an exemplary embodiment the reservoir and the barrier portion 9 are recessed below the surface of the orifice layer 2. In an exemplary embodiment, the reservoir 8 could be formed on the surface of a counter-bore 71 around an orifice 3. In exemplary embodiments, reservoirs 8, for example reservoirs similar to those described or shown in any one of FIGS. 1A through 7, may be recessed below the surface 7 of an orifice layer 2 and/or may be formed on the surface 72 of a counter-bore 71 around an orifice 3. In an exemplary embodiment, the counter-bore 71 is about 50 μm in diameter and about 10 μm deep.

In an exemplary embodiment, the surface of the reservoir 8, within the trenches, channels or grooves, is specially treated to improve wetting with the fluid to be ejected through the orifice 3, thereby decreasing the contact angle of the fluid 10A with the reservoir 8. In an exemplary embodiment, the barrier portion 9 is not treated to improve wetting. Improved wetting may be achieved by oxygen plasma treatment or special surface treatment including gold sputter coating followed by the reaction of alcohol or carboxylic acid terminated alkylthiol groups to the gold surface.

Figure 8:
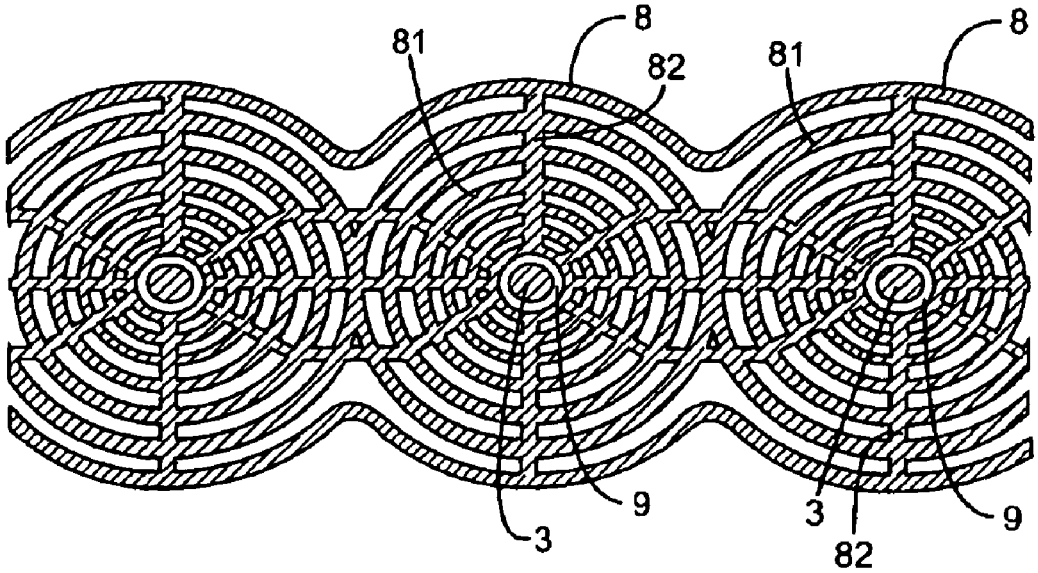
FIG. 8 illustrates a top view of an exemplary embodiment of an orifice layer.

FIG. 8 illustrates an exemplary embodiment of an orifice layer of a fluid ejection device. In an exemplary embodiment, the reservoirs for one of a plurality of nozzles of a given ink or fluid type are interconnected reservoirs associated with other of the plurality of nozzles. The reservoir channels extend so far from a corresponding orifice 3 that they intersect with the network of channels 81, 82 for a reservoir associated with a neighboring orifice 3.

FIGS. 9A and 9B illustrate an exemplary embodiment of an orifice layer of a fluid ejection device comprising a fluid ejection orifice 3, a reservoir 8 comprising channels 81, 82 and a reservoir feed orifice 31. The reservoir feed orifice 31 extends through the orifice layer 2 and feeds fluid 10 to the reservoir 8 but does not eject fluid droplets. In an exemplary embodiment, fluid in the orifice 31 is drawn into the reservoir by capillary action. In an exemplary embodiment the orifice 31 is not in direct fluid communication with a firing chamber 4, but is in direct fluid communication with a fluid feed channel 41 or other chamber or passage within the fluid ejection fluidics such that fluid can communicate with the surface 7 of the orifice layer 2 and feed fluid to the reservoir 8, but without ejecting fluid droplets when the firing resistor 6 fires.

It is understood that the above-described embodiments are merely illustrative of the possible specific embodiments which may represent principles of the present invention. Other arrangements may readily be devised in accordance with these principles by those skilled in the art without departing from the scope and spirit of the invention. The terms trench, channel and groove are used here alternatively for convenience in referring to various features described and are not intended to be construed narrowly or limiting.

What is claimed is:

1. A fluid ejection device, comprising:

an orifice structure including at least one orifice for ejecting droplets of fluid;

a fluid reservoir on an exterior surface of the orifice structure for holding a volume of the fluid on an exterior surface of the fluid ejection device, the fluid reservoir encircling one or more of the at least one orifice; and a barrier portion on the exterior surface of the fluid ejection device between the fluid reservoir and the at least one orifice.

2. The fluid ejection device of claim 1, wherein the barrier portion prevents fluid in the reservoir from being drawn into the at least one orifice.

3. The fluid ejection device of claim 1, wherein the barrier portion is wetting with respect to the fluid.

4. The fluid ejection device of claim 1, wherein the barrier portion is non-wetting with respect to the fluid.

5. The fluid ejection device of claim 1, wherein the reservoir is wettable with respect to the fluid.

6. The fluid ejection device of claim 1, wherein the reservoir has a capacity to hold sufficient fluid to slow the rate of diffusion of volatile portions of the fluid within the at least one orifice.

7. The fluid ejection device of claim 1, wherein the barrier portion has a width from about 2 μm to about 10 μm wide.

8. The fluid ejection device of claim 1, wherein the barrier portion has a width greater than about 2 μm.

9. The fluid ejection device of claim 1, wherein the reservoir has a capacity to hold a volume of fluid equal to about three times a volume of drops to be ejected from the at least one orifice.

10. The fluid ejection device of claim 1, wherein the reservoir has a capacity to hold a volume of fluid in a range from about 6 picoliters to about 60 picoliters.

11. The fluid ejection device of claim 1, wherein the reservoir has a capacity to hold a volume of fluid greater than about 6 picoliters.

12. The fluid ejection device of claim 1, wherein the barrier portion is textured.

13. The fluid ejection device of claim 12, wherein the texture comprises a network of grooves.

14. The fluid ejection device of claim 1, wherein the reservoir comprises a trench circumscribing an orifice exit.

15. The fluid ejection device of claim 1, wherein the reservoir portion comprises a network of channels.

16. The fluid ejection device of claim 15, wherein the network of channels extends to a distance of at least 30 μm from the at least one orifice.

17. The fluid ejection device of claim 15, wherein the network of channels comprises channels with a width of about 10 μm.

18. The fluid ejection device of claim 15, wherein the network of channels comprises channels with a width of about 20 μm.

19. The fluid ejection device of claim 15, wherein the network of channels comprises a plurality of concentric channels.

20. The fluid ejection device of claim 15, wherein the network of channels comprises a plurality of concentric channels and a plurality of radial channels connecting the concentric channels.

21. The fluid ejection device of claim 15, wherein the network of channels comprises a plurality of intersecting arcs which terminate at least at one end at the barrier portion.

22. The fluid ejection device of claim 1, wherein the reservoir portion is textured.

23. The fluid ejection device of claim 1, wherein the reservoir portion comprises a plurality of indentations.

24. The fluid ejection device of claim 1, wherein the reservoir comprises a plurality of channels.

25. The fluid ejection device of claim 24, wherein the plurality of channels comprises a plurality of channels extending radially outward from the barrier portion.

26. The fluid ejection device of claim 1, wherein the reservoir comprises an interlocking network of channels and a surface of the barrier portion comprises a network of grooves, wherein a curvature at an air/fluid interface in the grooves is less than a curvature at an air/fluid interface in the channels.

27. The fluid ejection device of claim 1, wherein the fluid reservoir is disposed on the exterior surface surrounding an exit of an individual orifice on the exterior surface.

28. A method of operating a fluid ejection device comprising:

ejecting droplets of fluid through an orifice in an orifice layer; and maintaining a volume of fluid in a reservoir encircling the orifice on an outer surface of the orifice layer.

29. The method of claim 28, wherein the droplets have a first volume and the volume of fluid in the reservoir equals at least about three times the volume of the first volume.

30. The method of claim 28, wherein the volume of fluid in the reservoir is in a range of about 6 picoliters to about 60 picoliters.

31. The method of claim 28, wherein the maintaining fluid on the surface comprises detaching the fluid in the reservoir from the orifice by a barrier portion to prevent the fluid from being pulled back into the orifice.

32. The method of claim 28, wherein the reservoir comprises a first portion separated from the orifice by a barrier portion and a second portion comprising channels cut across the surface of the barrier portion.

33. The method of claim 32, wherein the channels cut across the barrier portion are about 1 μm wide and 1 μm deep.

34. The method of claim 32, wherein the first portion comprises at least a first channel and the second portion comprises at least a second channel, wherein the first channel is deeper and wider than the second channel.

35. The method of claim 32, wherein the ejecting droplets through an orifice is done through a first orifice, and the maintaining fluid on the surface comprises feeding fluid into the reservoir through a second orifice.

36. A fluid ejection device, comprising:

an orifice structure having a surface that forms an exterior of the fluid ejection device, the orifice structure including at least one orifice from which fluid may be ejected from the fluid ejection device;

at least two channels formed on the surface of the orifice structure, the channels encircling one or more of the at least one orifice; and a barrier on the surface between the at least one orifice and the at least two channels.

37. The fluid ejection device of claim 36, wherein the barrier is wetting with respect to the fluid.

38. The fluid ejection device of claim 36, wherein the barrier is non-wetting with respect to the fluid.

39. The fluid ejection device of claim 36, wherein the at least two channels are wettable with respect to the fluid.

40. The fluid ejection device of claim 36, wherein the barrier has a width from about 2 μm to about 10 μm wide.

41. The fluid ejection device of claim 36, wherein the barrier has a width greater than about 2 μm.

42. The fluid ejection device of claim 36, wherein the at least two channels have a capacity to hold a volume of fluid equal to about three times a volume of drops to be ejected from the orifice.

43. The fluid ejection device of claim 36, wherein the reservoir has a capacity to hold a volume of fluid in a range from about 6 picoliters to about 60 picoliters.

44. The fluid ejection device of claim 36, wherein the reservoir has a capacity to hold a volume of fluid greater than about 6 picoliters.

45. The fluid ejection device of claim 36, wherein the barrier is textured.

46. The fluid ejection device of claim 45, wherein the texture comprises a network of grooves.

47. The fluid ejection device of claim 36, wherein the at least two channels extends to a distance of at least 30 μm from the orifice.

48. The fluid ejection device of claim 36, wherein the at least two channels comprise channels with a width of about 10 μm.

49. The fluid ejection device of claim 36, wherein the at least two channels comprise channels with a width of about 20 μm.

50. The fluid ejection device of claim 36, wherein the at least two channels comprise a plurality of concentric channels.

51. The fluid ejection device of claim 36, wherein the at least two channels comprise a plurality of concentric channels and a plurality of radial channels connecting the concentric channels.

52. The fluid ejection device of claim 36, wherein the at least two channels comprise a plurality of intersecting arcs which terminate at least at one end at the barrier.

53. The fluid ejection device of claim 36, wherein the at least two channels comprise a plurality of lobes extending radially outward from the barrier.

54. The fluid ejection device of claim 36, wherein the at least two channels are disposed on the surface surrounding an exit of one of the at least one orifice.

55. A fluid ejection device, comprising:

an orifice structure including at least one orifice from which fluid may he ejected and a surface that forms an exterior surface of the fluid ejection device;

means, encircling one or more of the at least one orifice, for maintaining some fluid on the surface of the orifice structure; and means for preventing fluid from the means for maintaining from being pulled into the orifice.

56. The fluid ejection device of claim 55, wherein the means for preventing is wetting with respect to the fluid.

57. The fluid ejection device of claim 55, wherein the means for preventing is non-wetting with respect to the fluid.

58. The fluid ejection device of claim 55, wherein the means for maintaining comprises means for maintaining a capacity to hold a volume of fluid equal to about three times a volume of drops to he ejected from the orifice.

59. The fluid ejection device of claim 55, wherein the means for preventing is textured.

60. The fluid ejection device of claim 55, wherein the means for maintaining has a capacity to hold sufficient fluid to slow the rate of diffusion of volatile portions of the fluid within the at least one orifice.

61. The fluid ejection device of claim 55, wherein the means for preventing is disposed on the surface of the orifice structure.

* * * * *

UNITED STATES PATENT AND TRADEMARK OFFICE

CERTIFICATE OF CORRECTION

PATENT NO. : 7,524,035 B2
APPLICATION NO. : 10/977065
DATED : April 28, 2009
INVENTOR(S) : Paul J. Bruinsma et al.

It is certified that error appears in the above-identified patent and that said Letters Patent is hereby corrected as shown below:

In column 10, line 59, in Claim 55, after "may" delete "he" and insert -- be --, therefor.

In column 11, line 6, in Claim 58, before "ejected" delete "he" and insert -- be --, therefor.

Signed and Sealed this

Fifteenth Day of September, 2009

David J. Kappos

David J. Kappos
*Director of the United States Patent and Trademark Office*